US005582037A

United States Patent [19]

DiDomenico

[11] Patent Number: 5,582,037

[45] Date of Patent: *Dec. 10, 1996

[54] PIERCED EARRING ASSEMBLY

[76] Inventor: Joseph DiDomenico, 575 Mount Pleasant Ave., Providence, R.I. 02908

[ * ] Notice: The portion of the term of this patent subsequent to Dec. 15, 2009, has been disclaimed.

[21] Appl. No.: 73,138

[22] Filed: Jun. 7, 1993

[51] Int. Cl.[6] ..... A44C 7/00

[52] U.S. Cl. ..... 63/12; 63/1.1; 63/DIG. 3

[58] Field of Search ..... 63/12, DIG. 3, 63/1.1, 14.1, 20

[56] References Cited

U.S. PATENT DOCUMENTS

| | | | |
|---|---|---|---|
| 3,260,068 | 7/1966 | Micallef | 63/12 |
| 3,910,065 | 10/1975 | Holt | 63/12 |
| 4,593,540 | 6/1986 | Cuvar et al. . | |
| 4,653,292 | 3/1987 | Maupin et al. | 63/12 |
| 4,682,477 | 7/1987 | Vaillancourt | 63/12 |
| 4,829,788 | 5/1989 | DiDomenico | 63/12 |
| 4,840,045 | 6/1989 | Moody | 63/12 |
| 5,018,365 | 5/1991 | Luceno | 63/12 |
| 5,094,090 | 3/1992 | Bone | 63/20 |
| 5,170,641 | 12/1992 | DiDomenico | 63/12 |
| 5,201,197 | 4/1993 | Bakker | 63/12 |

FOREIGN PATENT DOCUMENTS

| | | | |
|---|---|---|---|
| 276197 | 7/1988 | European Pat. Off. | 63/12 |

*Primary Examiner*—Michael J. Milano
*Attorney, Agent, or Firm*—Salter & Michaelson

[57] ABSTRACT

An adaptor enables a pierced earring of the type having an ornament and a metallic post to be converted into a pierced earring assembly having a hypoallergenic plastic post. The adaptor consists of a body having a longitudinal bore which is adapted for receiving the earring's metallic post, and a plastic post extending outwardly from the body. For assembly of the earring and adaptor, the metallic post of the earring is bent downwardly and slidably inserted into the bore. A small notch is provided at the upper edge of the body for receiving a rearwardly extending portion of the metallic post when the downwardly extending portion of the post is fully inserted into the bore. The notch is effective for preventing the earring from rotating when assembled with the adaptor. The plastic post extends rearwardly from the body portion and it is adapted for insertion through the pierced ear lobe of a wearer so that the pierced earring assembly may be worn in a conventional manner.

4 Claims, 1 Drawing Sheet

PIERCED EARRING ASSEMBLY

BACKGROUND AND SUMMARY OF THE INVENTION

The instant invention relates generally to pierced earrings and more particularly to an adaptor which enables a pierced earring of the type conventionally comprising an ornament and a metallic post to be converted into a pierced earring assembly having a plastic post.

It is well known in the art that pierced earrings are widely favored over clip-on or screw-back earrings because they are less likely to become inadvertently detached from the wearer's lobe and lost than are clip-on or screw-back earrings. However, one of more unfortunate drawbacks of pierced earrings is the fact that the wearer's lobe frequently becomes irritated or infected by repeated penetration of the metallic post through the pierced lobe of the wearer even where the post is fashioned from hypoallergenic metals such as surgical steel or gold.

The prior art has recognized this drawback and has attempted to remedy the problem by providing a plastic sleeve which is received over the metallic post of a conventional pierced earring so that the lobe does not make direct contact with the metallic post. This concept is embodied in the U.S. Pat. No. 4,067,341, to Ivey. While the plastic sleeve concept has met with some success, it has been found that it is not entirely practical because it significantly increases the diameter of the post and accordingly, people with small openings in their lobes may not be able to extend the post and sleeve through the opening. In other cases, the wearer must stretch their lobe openings to accommodate the increased diameter of the post. Still further, there is a problem associated with proper positioning of the sleeve on the post to prevent the wearer's lobe from contacting the post.

It has also been known in the art to completely replace the metallic post with a plastic post and to use a plastic clutch. This approach is embodied in the U.S. Pat. No. 4,593,540 to Cuvar wherein a plastic post is provided with an enlarged flange on one end thereof. The flange is adapted to be secured by cement to the back side of an ornament. One obvious drawback to this approach is that the back side of many earring have a curved configuration and it is nearly impossible to secure a flat flange to a curved surface.

The instant invention seeks to remedy the problems of the prior art by providing a novel post adaptor which enables a conventional pierced earring of the type having an ornament and a metallic post to be converted into a pierced earring assembly having a plastic post. Briefly, the adaptor comprises a rectangular body portion having a longitudinal bore which is adapted for receiving the metallic earring post, a plastic post extending outwardly from the body portion, a small notch at the upper edge of the body portion adjacent to the bore, and a plastic clutch. For assembly of the adaptor with an earring, the metallic post of the earring is bent downwardly, and slidably inserted into the bore so that a rearwardly extending portion of the earring post is received in the notch when the downwardly extending portion of the post is fully inserted into the body portion. The notch effectively prevents the earring from rotating when assembled with the adaptor. The plastic post is adapted for insertion through the pierced lobe of a wearer and the clutch is frictionally received thereon so that the assembly may be worn in a conventional manner.

Accordingly, it is an object of the instant invention to provide an adaptor which enables a pierced earring having an ornament and a metallic post to be converted into a pierced earring assembly having a plastic post.

It is another object to provide a plastic post on an earring assembly wherein the plastic post has a diameter which is no larger than the diameter of a conventional metallic post.

It is still another object to provide an adaptor which is easily assembled and disassembled from an earring so that it may be utilized with a plurality of different earrings.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
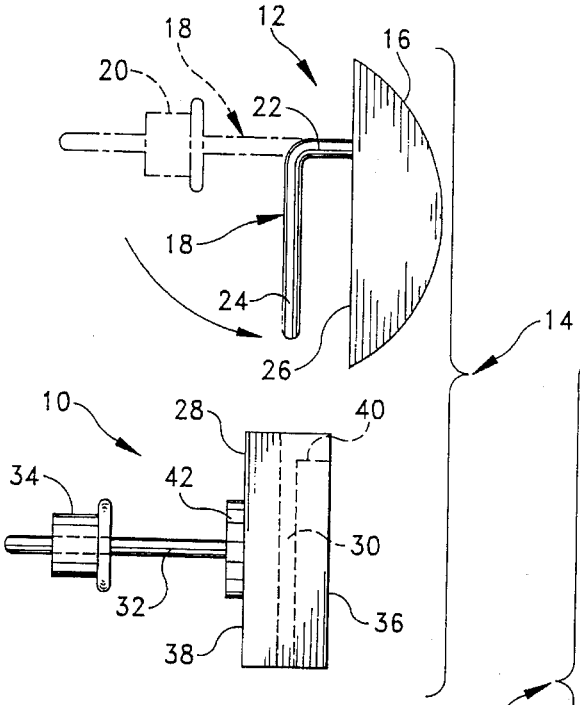
FIG. 1 is an exploded side view showing the pierced earring and the post adaptor of the instant invention.
Figure 2:
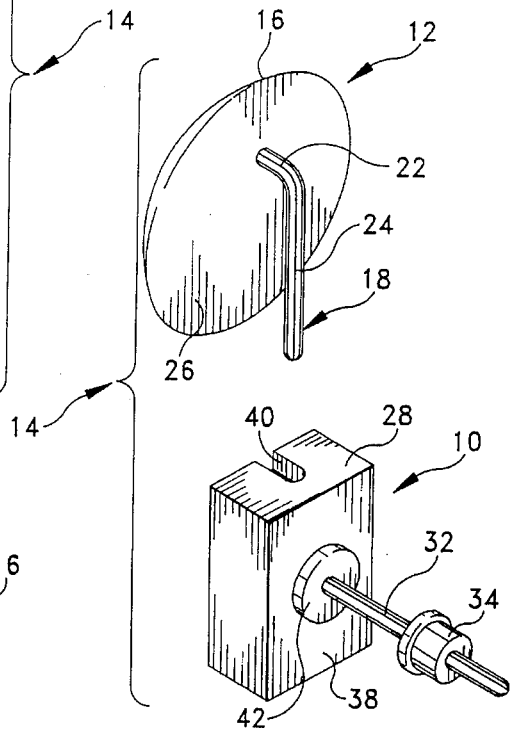
FIG. 2 is an exploded rear perspective view thereof.

Referring now to the drawings, the adaptor of the instant invention is illustrated and generally indicated at 10 in FIGS. 1 through 5. As will hereinafter be more fully described, the adaptor 10 enables a conventional pierced earring generally indicated at 12 to be converted into a pierced earring assembly 14 having a hypoallergenic plastic post.

The earring 12 comprises a decorative ornament 16, a rearwardly extending metallic post 18 (shown in broken lines FIG. 1), and a conventional clutch member 20. For assembly of the earring 12 with the adaptor 10, the clutch member 20 is removed and the post 18 is bent downwardly so as to provide a rearwardly extending portion 22 and a downwardly extending portion 24 which is positioned in slightly spaced relation from the back side 26 of the ornament 16.

The adaptor 10 is preferably integrally formed from a rigid, yet resilient plastic, such as nylon, and it comprises a rectangular body portion 28 having a longitudinal bore 30 therein which is adapted for slidably and frictionally receiving the downwardly extending portion 24 of the metallic earring post 18, a rearwardly extending post 32, and a plastic clutch 34. The rectangular body includes a forwardly facing surface 36, and a rearwardly facing surface 38. A notch 40 is provided at an upper edge of the forwardly facing surface 36 of the body portion 28 for receiving the rearwardly extending portion 22 of the earring post 18 when the downwardly extending portion 24 is fully inserted into the bore 30. The notch 40 is effective for preventing rotation of the earring 12 when assembled with the adaptor 10. The rearwardly facing surface 38 of the body portion 28 is preferably provided with a circular flange 42 which extends outwardly therefrom. The adaptor post 32 extends rearwardly from the center of the flange 42 and it is adapted to be inserted through a pierced opening in an earlobe. The diameter of the post 32 is preferably no greater than 0.031 inches. The circular flange 42 is operable for decreasing the pressure area on the wearer's lobe thereby making the earring more comfortable to wear, although, if desired, the flange 42 may be eliminated, wherein the post 32 would directly extend from the rearwardly facing surface 38 of the body portion 28.

Figure 3:
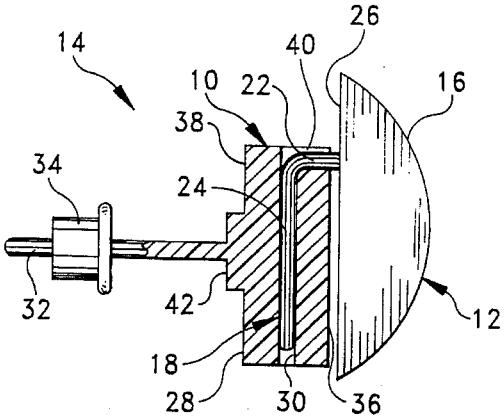
FIG. 3 is an assembled side view thereof with portions of the adaptor broken away for purposes of illustration.
Figure 4:
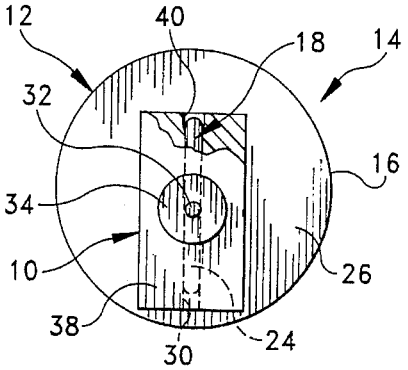
FIG. 4 is a rear view thereof with portions of the adaptor broken away for purposes of illustration.
Figure 5:
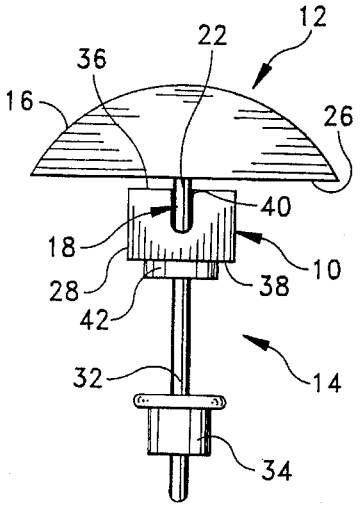
FIG. 5 is a top view thereof.

For assembly of the earring 12 and the adaptor 10, the earring post 32 is bent as described above, and the downwardly extending portion 24 of the earring post 18 is slidably inserted into the bore 30 so that the rearwardly extending portion 22 of the post 18 is received within the notch 40 (FIG. 3). It is pointed out that the post 18 is received with a friction fit in the bore 30 so that the post 18 may be easily removed from the body portion 28, thereby allowing the adaptor 10 to be utilized with a plurality of different earrings. For attachment of the earring assembly 14 to the lobe of a wearer, the plastic post 32 is inserted through the pierced opening in the lobe and the plastic clutch 34 is received over the end of the post 32 to secure the earring assembly 14 to the lobe.

It is seen therefore that the instant invention provides a novel post adaptor 10 which enables a conventional pierced earring 12 having a metallic post 18 to be converted into a pierced earring assembly 14 having a plastic post 32. The adaptor 10 is integrally formed from a plastic material, such as by molding, and therefore contains no metallic components which may irritate the wearer's lobe. The adaptor 10 comprises a body portion 28 having a bore 30 which is adapted for slidably and frictionally receiving the metallic post 18 of the earring 12 and it further includes a plastic post 32 which extends rearwardly from the body 28. The plastic post 32 has a diameter which is no greater than a conventional metal post 18 and it is adapted to be inserted through the pierced opening in an earlobe. A notch 40 is provided at the top edge of the body 28 for snugly receiving a rearwardly extending portion 22 of the bent metallic post 18. The notch 40 is effective for preventing the earring 12 from rotating when assembled with the adaptor 10. For these reasons, the instant earring adaptor is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. In combination, a pierced earring comprising an ornament and a metallic cylindrical post extending therefrom, said metallic post being bent downwardly, the combination further comprising a plastic adaptor having a body with a bore therein which slidably and frictionally receives said downwardly bent portion of said metallic post, said adaptor further having a plastic cylindrical post extending rearwardly therefrom, said plastic post having a diameter equal to or less than that of said metallic post and being adapted to be inserted through a pierced opening in an earlobe.

2. In the adaptor of claim 1, said plastic post having a diameter no greater than 0.031 inches.

3. An adaptor for a pierced earring of the type comprising an ornament and a metallic post extending therefrom, said metallic post being bent downwardly, said adaptor comprising:

a plastic body having a bore which is adapted for slidably and frictionally receiving a downwardly extending portion of said metallic post;

a plastic post extending rearwardly from said body, said post being adapted to be inserted through a pierced opening in an earlobe; said metallic post being bent downwardly so as to provide a rearwardly extending portion and a downwardly extending portion, said adaptor further comprising notch means at an upper edge of said body for receiving the rearwardly extending portion of said post when said metallic post is fully inserted into said bore.

4. In the adaptor of claim 3, said body having a rearwardly facing surface, and a raised plastic flange on said rearwardly facing surface, said plastic post extending rearwardly from said flange.

* * * * *